United States Patent [19]

Blitzer et al.

[11] Patent Number: 4,848,054

[45] Date of Patent: Jul. 18, 1989

[54] MINIATURE CEILING BEAM T-BAR COVER CAP

[76] Inventors: Jacob H. Blitzer, 400 S. Saltair, Los Angeles, Calif. 90049; Richard M. O'Toole, 4495 Huntley Ave., Culver City, Calif. 90230

[21] Appl. No.: 161,167

[22] Filed: Feb. 26, 1988

[51] Int. Cl.[4] ..... E04B 5/52; E04F 19/02

[52] U.S. Cl. ..... 52/488; 52/484; 52/716; 52/DIG. 8

[58] Field of Search ..... 52/484, 488, DIG. 8, 52/311, 664, 469, 461, 716

[56] References Cited

U.S. PATENT DOCUMENTS

| | | | |
|---|---|---|---|
| 1,865,131 | 6/1932 | Olsen | 52/DIG. 8 |
| 2,152,418 | 3/1939 | Olsen | 52/484 |
| 3,049,341 | 8/1962 | Kemp | 52/484 |
| 3,067,323 | 12/1962 | Kember | 52/484 |
| 3,139,162 | 6/1964 | Spangenberg | 52/484 |
| 3,212,224 | 10/1965 | Spangenberg | 52/484 |
| 3,241,280 | 3/1966 | Kreuzer | 52/311 |
| 3,277,624 | 10/1966 | Cornell | 52/484 |
| 3,310,922 | 3/1967 | Hoffmann, Jr. | 52/664 |
| 3,387,872 | 6/1968 | Sovullo et al. | 52/486 |
| 3,594,972 | 7/1971 | Jones | 52/461 |
| 3,596,425 | 8/1971 | Kodaras | 52/484 |
| 3,685,238 | 8/1972 | Fisher et al. | 52/484 |
| 3,977,144 | 8/1976 | Jahn | 52/664 |
| 4,569,175 | 2/1986 | Abcuik | 52/484 |
| 4,718,213 | 1/1988 | Butterfield | 52/DIG. 8 |

FOREIGN PATENT DOCUMENTS

| | | | |
|---|---|---|---|
| 2039583 | 8/1980 | United Kingdom | 52/664 |

*Primary Examiner*—Michael Safavi

*Attorney, Agent, or Firm*—J. E. McTaggert

[57] ABSTRACT

For easy installation onto conventional inverted T-bar subceiling support framework, hollow miniature beams of this invention are readily attached onto the bottom flanges of the T-bar rails without requiring fastening hardware or tools. The beams are supported by return flanges at the top of their sidewalls, resting on the top sides of the flanges of the T-bar rail. The beams may be extruded from plastic for light weight, reinforced by a transverse web bridging the top region of the sidewalls. Other U-shaped configurations, without the web, are suited to roll- or brake-forming from sheet metal, or extruding from aluminum. A longitudinal groove is provided along the upper portion of each sidewall; the inward intrusions of the grooves, in co-operation with the bridge web when used, function as a strike plate against the bottom side of the rail flanges to constrain the beam from skewing or working upwards. The groove contributes to the strength and light weight of the beam, and provides a distinctive styling feature in the overall appearance of the subceiling. Notches, for intersection clearance in standard support framework grid patterns, may be provided in the beams as supplied from the factory, and/or custom notching may be implemented in the field.

18 Claims, 2 Drawing Sheets

FIG. 1
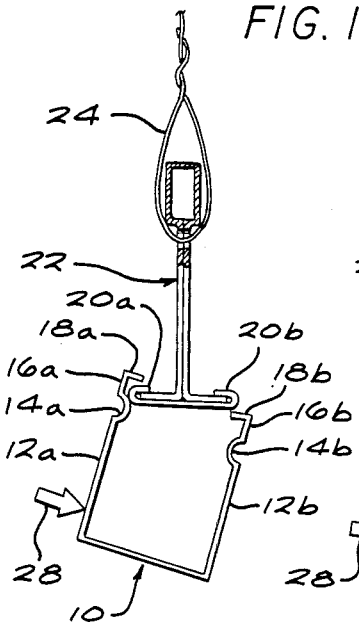
FIG. 2
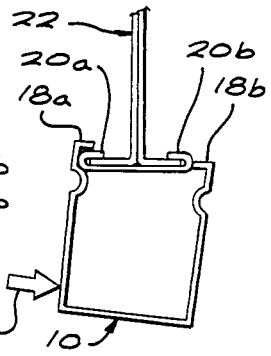
FIG. 3
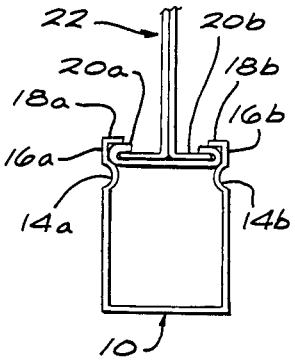
FIG. 4
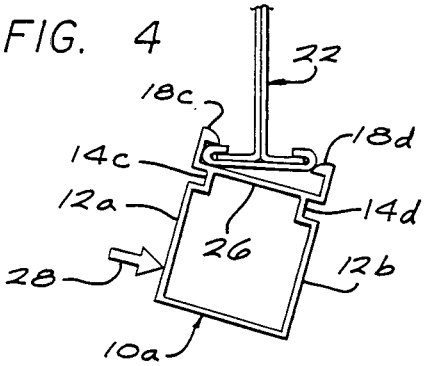
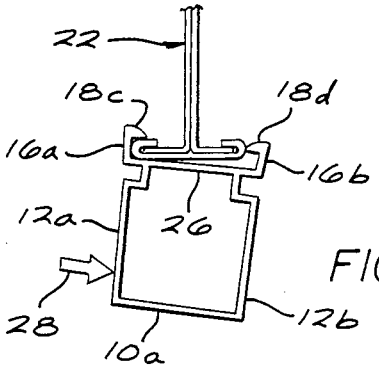
FIG. 5
FIG. 6
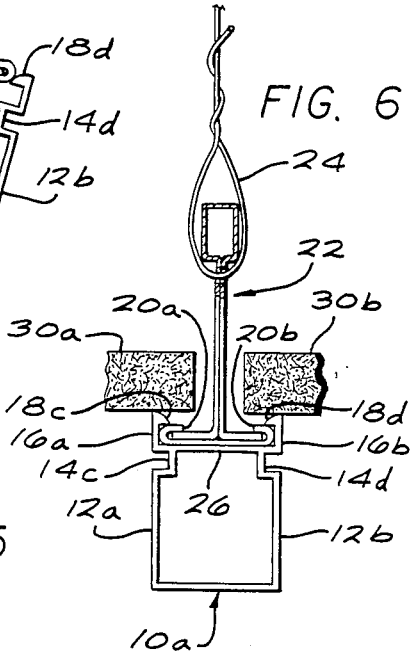

MINIATURE CEILING BEAM T-BAR COVER CAP

FIELD OF THE INVENTION

This invention relates to the field of subceilings of the type having square or rectangular panels supported in a suspended framework of inverted T-bar rails forming a grid pattern. More particularly this invention relates to hollow simulated beams which may be readily attached onto commonly-used inverted T-bar rails.

BACKGROUND OF THE INVENTION

Prior Art

Subceilings formed from square or rectangular panels resting on horizontal bottom flanges of inverted T-bar rails are well-known; typically a framework of rails is configured with parallel main runners, suspended from above, intersecting with cross rails to form a grid pattern, usually 2'×2' or 2'×4'. In the basic functional form of such subceilings, the bottom surfaces of the rail flanges are left exposed as flat boundary strips between the edge-supported panels, as shown, for example, in U.S. Pat. No. 3,977,144 to Jahn. In a commonly-used style of inverted T-bar rail that has become dimensionally standardized, the flanges are enclosed by a tight-fitting cap defining a smooth flat bottom surface and substantially rounded edges.

It has been a long-sought objective to facilitate remodelling of existing suspended subceilings having exposed flat T-bar flange strips by the addition of simulated beams to present an open beam architectural styling effect. U.S. Pat. Nos. 2,152,418 to Olsen, 3,241,280 to Kreuzer, and 3,685,238 to Fisher et al. show hollow beams formed as a downwardly-extending part incorporated into a form of T-bar subceiling support framework. However, such beam-shaped support rails are suited to new ceilings only, since they are not retrofittable onto an existing subceiling framework and would therefore necessitate costly removal and replacement of existing support framework and suspension hardware; furthermore, the possibility of future redecorating by changing to new beams of different shape or color would be precluded.

Supporting detachable beams on suspended rails has been taught in U.S. Pat. Nos. 1,865,131 to Olsen and 3,277,624 to Conrell, however these require the use of specialized, non-standard suspended rails, and are thus incompatible with conventional inverted T-bar suspended rails.

A specialized clip for attaching imitation ceiling beams to inverted T-bar framework is taught by Lovullo et al. in U.S. Pat. No. 3,387,872; the use of such hardware fastening items is avoided in the novel fastening method of the present invention, as one of its objects.

Prior art has failed to provide satisfactory decorative beams which may be readily added onto an installed framework of commonly-used inverted T-bar rails, both for renovating existing ceilings, and for providing in new ceiling installations the potential of convenient future renovation by changing to beams of different size, shape, color or texture, without altering or disturbing the support framework.

SUMMARY OF THE INVENTION

It is a primary object of the present invention to provide a hollow beam which may be readily attached to a conventional T-bar support rail from below without requiring additional fastening hardware such as clips or screws.

It is a further object to provide strike plates within the beams which will constrain them against skewing or riding upwards on the rail flanges.

It is still a further object to provide an embodiment having a distinctive grooved appearance feature along the upper portion of both exposed sidewalls of the beam.

These objects have been accomplished in this invention, as set forth along with other features in the following detailed description and accompanying drawings.

BRIEF DESCRIPTION OF THE DRAWINGS

FIG. 1 is a cross-sectional view of a beam configured in accordance with a first embodiment of this invention, in an initial position in the process of installation onto a conventional inverted T-bar rail.

FIG. 2 is a cross-sectional view of the beam of FIG. 1 in an intermediate position in the process of installation.

FIG. 3 is a cross-sectional view of the beam of FIG. 1 in a position, installed onto a rail.

FIG. 4 is a cross-sectional view of a beam configured in accordance with a second embodiment of this invention, in an initial position in the process of installation onto a conventional inverted T-bar rail.

FIG. 5 is a cross-sectional view of the beam of FIG. 4 in an intermediate position in the process of installation.

FIG. 6 is a cross-sectional view of the beam of FIG. 4 in a final position, installed onto a rail, with ceiling panels in place.

DETAILED DESCRIPTION

Figure 7:
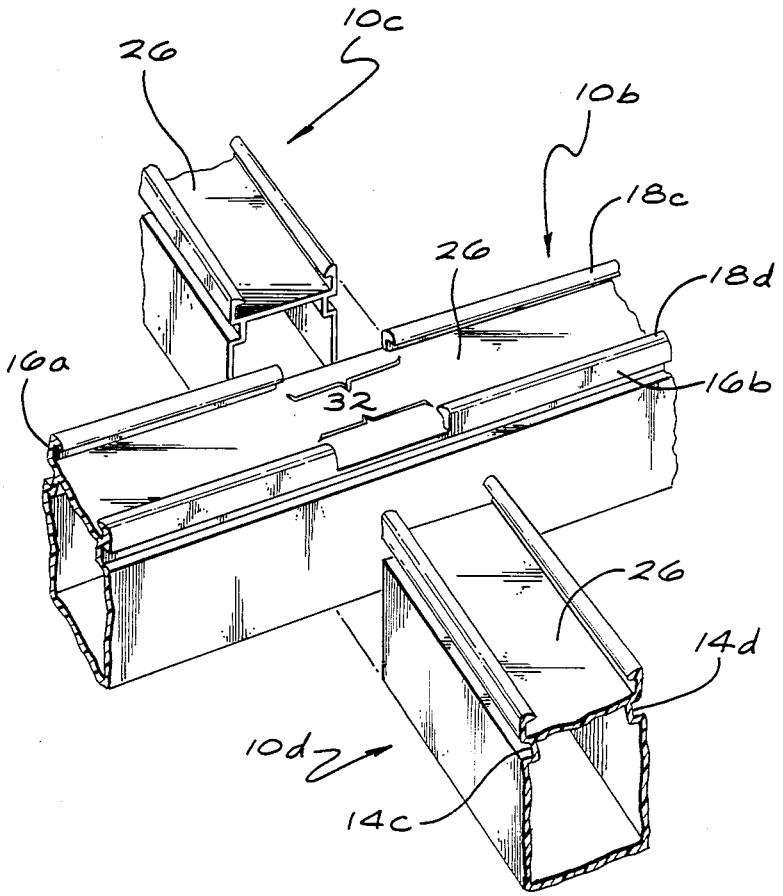
FIG. 7 is an exploded perspective view of an intersection of a main runner beam and two cross beams.

Referring to FIG. 1, this cross-sectional view shows the hollow configuration of a beam 10 configured in accordance with the present invention in a first embodiment, generally suitable for fabrication from metal. Parallel sidewalls each have a main portion **12*a* and 12*b* topped by inwardly-disposed longitudinal grooves 14*a* and 14*b* of generally semicircular cross-section. Above the grooves 14*a* and 14*b*, narrow upper sidewall portions 16*a* and 16*b*, located in the same planes as corresponding lower sidewalls 12*a* and 12*b* respectively, are topped by relatively narrow inwardly disposed return flanges 18*a* and 18*b*. The beam 10 is shown with return flange 18*a* hooked over the rolled flange edge 20*a* of rail 22, which is a commonly-used type of inverted T-bar rail. A light force applied by hand as indicated at arrow 28 holds return flange 18*b* pressed upwardly against the lower side of flange edge 20*b*, in an initial position in the process of installing beam 10 onto T-bar rail 22. A typical support wire 24 is shown looped through an opening in the web region of rail 22**, suspending it from building structure above.

Referring now to FIG. 2, beam 10 of FIG. 1 is shown again in cross-section, now moved to an intermediate position in process of installation onto rail 22: increased force applied at arrow 28 has caused beam 10 to rotate slightly counterclockwise with flange edge **20*a* acting as a pivot point, spreading the upper sidewalls slightly as return flange 18*b* rides up onto the rounded T-bar flange edge 20*b*** as shown.

FIG. 3 shows the beam 10 in its final installed position following a continuation of the previous rotational movement until return flange 18*b* clears the upper side of rail flange 20*b* and springs back to its normal position as shown, with beam 10 supported by return flanges 18*a* and 18*b* resting on the upper surfaces of rail flanges 20*a* and 20*b*.

The ribs formed internally from grooves 14*a* and 14*b* are located such that upon installation their upper portions are disposed immediately below rail flanges 20*a* and 20*b*, where, as seen in FIG. 3, they form strike plates acting against any tendancy of the beam 10 to ride further upward or to skew relative to T-bar rail 22. The material used in beam 10 must have sufficient compliance to permit the return flanges 18*a* and 18*b* to spread apart sufficiently to clear the rail flange 18 during installation as shown in FIG. 2, and also must have sufficient resiliance to return the sidewalls to their original parallel position when installed as shown in FIG. 3, preferably exerting a slight bias against the edges of rail flanges 20*a* and 20*b*. It will be noted that return flanges 18*a* and 18*b* are formed to incline slightly downward toward their inward-facing edges: compared to a simple rectangular disposition, the incline facilitates installing the beam 10 onto the T-bar rail 22 and helps ensure good retention of the installed beam.

Referring now to FIG. 4, a cross-section is shown of a second embodiment of the present invention, which is suitable for extrusion from plastic. This second embodiment differs from the first embodiment (FIGS. 1, 2, and 3) in the addition of a bridge web 26, tying together the sidewalls 12*a* and 12*b* and forming the upper walls of grooves 14*c* and 14*d*, which are made rectangular in cross-section instead of the semicircular shape of grooves 14*a* and 14*b* seen in FIGS. 1, 2 and 3. Bridge web 26 serves to maintain the orthogonal shape of beam 10*a*. It will be noted that return flanges 18*c* and 18*d* are extruded to have a tapered shape with a curved, downwardly inclined upper surface.

FIG. 5 shows the beam 10*a* moved to the intermediate installation position (corresponding to FIG. 2). It is seen in FIG. 5 that the required spreading apart of return flanges 18*c* and 18*d* must be provided by flexure in the region of the upper sidewalls 16*a* and 16*b*, since bridge web 26 prevents spreading of the lower sidewalls 12*a* and 12*b*. The material of beam 10*a* must be sufficiently compliant to flex temporarily as required in this position and sufficiently resiliant to return to normal shape afterwards.

FIG. 6 shows the beam 10*a* in its final installed position on rail 22, suspended by support wire 24. Upper sidewalls 16*a* and 16*b* have sprung back to their normal positions, such that return flanges 18*c* and 18*d* rest on rail flanges 20*a* and 20*b*, supporting beam 10*a* in the same manner as in FIG. 3. It is seen in FIG. 6 that bridge web 26 serves along with the upper edges of grooves 14*c* and 14*d*, as a strike plate constraining beam 10*a* from skewing or working upward on rail flanges 20*a* and 20*b*. Bridge web 26 further serves to ensure retention of the beam 10 onto rail flanges 20*a* and 20*b* by constraining the sidewalls 12*a* and 12*b* and the return flanges 18*c* and 18*d* against spreading apart in normal service with the beam in its installed position.

End portions of ceiling panels 30*a* and 30*b* are shown in place resting on top of return flanges 18*c* and 18*d*. The weight of the panels 30*a* and 30*b* serves as an additional force tending to align and retain beam 10*a* in place in its installed position.

FIG. 7 is an exploded perspective view showing how an intersection is formed between a main runner beam 10*b* and two cross beams 10*c* and 10*d*. These three beams, shown in part, are configured in accordance with the second embodiment of this invention; that is, having a bridge web 26 and rectangular side grooves 14*c* and 14*d* as in FIGS. 4, 5, and 6. For clarity of illustration, cross beams 10*c* and 10*d* are shown separated from main runner beam 10*b* and the supporting T-bar rails are not shown; however, in an actual installation, beams 10*c* and 10*d* would be installed as shown in FIGS. 4, 5 and 6 onto a corresponding support framework intersection of two cross rails and a main runner rail, and the ends of beams 10*c* and 10*d* would be made to abut closely against the sidewalls of beam 10*b*. It is seen that the upper sidewalls 16*a* and 16*b* and return flanges 18*c* and 18*d* of main runner beam 10*b* are cut away to form a pair of notches 32, opposite each other, extending downward to near the level of the bridge web 26 as shown; notches 32 as shown are required at each intersection to provide clearance for intersecting T-bar rails 22 since the rail flanges (20*a* and 20*b* in FIG. 6) extend downward to near the level of the bridge web 26. Beams intended as main runners may be supplied already notched at standard intervals and/or notches 32 may be cut as required in the field with ordinary or custom cutting tools; score-lines (in at least the longitudinal direction) may be provided at potential intersection locations in the beams, to facilitate field notching.

There are a number of alternative manufacturing methods capable of producing beams within the scope of this invention. The second embodiment as previously described in connection with FIGS. 4, 5 and 6, may be considered the preferred embodiment since it provides light weight, low cost and other advantages of extruding the beam from plastic such as ABS. The first embodiment as described in connection with FIGS. 1, 2 and 3, having no bridge web, could be roll-formed or brake-formed sheet steel or aluminum, or extruded from an aluminum alloy.

In either embodiment, alternative shapes may be chosen for the longitudinal grooves 14: the semicircular shape shown in FIGS. 1, 2 and 3, the rectangular shape shown in FIGS. 4, 5 and 6, or other shapes such as square or triangular. Alternatively, the sidewalls 12*a* and 12*b* could be made completely planar by the elimination of grooves 14; however, in extruding or molding there is risk of unsightly sink lines appearing on the outside of the sidewalls opposite any internal discontinuity such as a bridge web. It is preferable to incorporate grooves 14 since they serve to (a) minimize the risk and impact of such sink lines, (b) provide a rail flange strike plate internally, (c) contribute to the strength and light weight of the beams and (d) provide a distinctive appearance feature.

In the second embodiment, which is extruded from plastic, the sidewall thickness is made 0.030". The width of return flanges 18*c* and 18*d* is important: an optimum value must be chosen to be wide enough to ensure beam retention, yet not too wide to permit easy installation. In this embodiment, the return flanges 18*c* and 18*d* extend inward 0.035" from the inner sidewall and are tapered with their upper side curved downward toward their inward-facing edge as shown; the notches 32 extend downward 0.160" from the upper edge of the sidewall, while the upper surface of the bridge web 26 is approximately 0.190" below the upper edge of the sidewall.

Beams 10 may be spliced end to end by insert means shaped to enter and frictionally engage the two open beam ends.

As an alternative to the installation method shown in FIGS. 1 through 6 (where a beam is tilted sideways and hooked over one rail flange edge along its entire length), if the beam is made from plastic having sufficient compliance and resilience, it may be possible, starting at one end with the beam not tilted but urged squarely up against the rail flange, to then push the beam end upward to spread the return flanges apart and move them upward past the rail flange simultaneously, then working progressively in a similar manner along the beam to its other end.

These and other alternatives, derivatives and substitutions which may become apparent to those of skill in the art without departing from the spirit and principles of the matter disclosed and claimed herein are intended to be encompassed within the scope of the invention.

What is claimed is:

1. In a subceiling of the type having panels supported by a suspended framework of main runner members and cross runner members, each runner member being configured as an inverted T-bar rail having a transverse pair of opposed bottom flanges extending to a standardized total width, in combination with said rails and attachable thereto as decorative cover caps, a plurality of miniature hollow beams formed from sheet metal in a manner to provide integral self-sufficient fastening means, each of said beams comprising:

a flat base portion;

a pair of generally vertical sidewalls flanking and adjoining said base portion, each of said sidewalls having an upper edge;

a first return flange disposed along the upper edge of one of said sidewalls, extending inwardly; and a second return flange disposed along the upper edge of the other of said sidewalls, extending inwardly;

each of said return flanges having an upward-facing surface, a downward-facing surface and an inward-facing edge;

wherein said sidewalls are spaced apart from each other, at least in an upper region, by a distance approximately equal to the total width of the rail flanges, wherein said beam is formed to have a longitudinal groove of approximately semicircular cross-section recessed inwardly in an upper region of each sidewall along the entire length thereof, said groove constituting a corresponding rib on an inward-facing surface of the sheet metal, said rib being located so as to act in the manner of a strike plate against a downward-facing surface of a rail flange, and wherein said beam is made to be sufficiently compliant and resilient to enable attachment onto one of said rails by urging said beam upwardly atainst the rail flanges in a manner causing the return flanges to be temporarily spread apart compliantly from an original spacing so as to allow the return flanges to move upwardly past the rail flanges and to then return resiliently to the original spacing so as to thus engage the beam onto the rail in an installed position such that said beam is (a) supported by the downward-facing surfaces of both return flanges resting upon upward-facing surfaces of the rail flanges, (b) constrained laterally by said sidewalls flanking said rail flanges, and (c) constrained vertically by said ribs against skewing or riding upwardly on the rail flanges; thus said beam is caused to be securely fastened to said rail, the panels being supported peripherally on the upward-facing surfaces of said return flanges.

2. The invention as in claim 1 wherein each of said return flanges is made with said upward-facing edge inclined downwardly toward said inward-facing edge, so as to assist in installing said beam onto the rail flange by tending to spread the upper edges of said sidewalls apart from each other and to guide said return flange upwardly past the rail flanges to said installed position.

3. The invention as in claim 1 wherein selected ones of said beams are each provided with a plurality of rectangular notches located in an upper region thereof, each of said notches being located at a potential location of a support framework intersection so as to provide clearance for the support framework intersection.

4. The invention as in claim 3 wherein each of said return flanges is made with said upward-facing surface inclined downwardly toward said inward-facing edge, so as to assist in installing said beam onto the rail flange tending to spread the upper edges of said sidewalls apart from each other and to guide said return flanges upwardly past the rail flanges to said installed position.

5. In a subceiling of the type having flat panels supported in a single plane by a suspended framework of main runner members and cross runner members, each runner member being configured as an inverted T-bar rail having a transverse pair of opposed bottom flanges extending to a standardized total width, in combination with said rails and attached thereto as decorative cover caps, a plurality of hollow beams including integral self-sufficient fastening means, each of said beams comprising:

a flat base portion;

a pair of generally vertical sidewalls flanking and adjoining said base portion, each of said sidewalls having an upper edge;

a first return flange disposed along the upper edge of one of said sidewalls, extending inwardly; and a second return flange disposed along the upper edge of the other of said sidewalls, extending inwardly;

each of said return flanges having an upward-facing surface, a downward-facing surface and an inward-facing edge;

wherein said sidewalls are spaced apart from each other, at least in an upper region, by a distance approximately equal to the total width of the rail flanges, wherein selected ones of said beams are each provided with a plurality of rectangular notches located in an upper region thereof, each of said notches being located at a potential location of a support framework intersection so as to provide clearance for the support framework intersection, and wherein said beam is made to be sufficiently compliant and resilient to enable attachment onto one of said rails by urging said beam upwardly against the rail flanges in a manner causing the return flanges to be temporarily spread apart compliantly from an original spacing so as to allow the return flanges to move upwardly past the rail flanges and to then return resiliently to the original spacing so as to thus captivate the rail flanges in an installed position such that the beam is (a) supported by the downward-facing surfaces of both return flanges resting upon upward-facing surfaces of the rail flanges, and (b) constrained laterally by said sidewalls flanking said rail flanges; thus said beam is caused to be securely attached to said rail, the panels being supported peripherally upon the upward-facing surfaces of said return flanges.

6. The invention as in claim 5 wherein each of said inward-facing return flanges is made with said upward-facing surface inclined downwardly toward said inward-facing edge, so as to assist in installing said beam onto the rail flange by tending to spread the upper edges of said sidewalls apart from each other and to guide said return flanges upwardly past the rail flanges to said installed position.

7. The invention as in claim 5 further comprising at least one pair of score lines of reduced strength located opposite each other in an upper region of said sidewalls, each of said score lines corresponding to at least a portion of a rectangular outline of a potential clearance notch location, so as to facilitate removal of material therefrom in forming a notch therein to provide clearance at a support framework intersection, whenever required.

8. The invention as in claim 1 further comprising, on an inward-facing surface of each sidewall of said beam, a longitudinal rib, located such that when said beam is in said installed position, the rib is positioned immediately beneath an edge of a corresponding rail flange, thus enabling the rib to act as a strike plate against the rail flange, holding said beam in said installed position, constrained against skewing or riding upward on the rail flange.

9. The invention as in claim 8 wherein said sidewalls are shaped to have a longitudinal groove disposed in an upper region of each sidewall along the entire length thereof.

10. The invention as in claim 9 wherein said longitudinal groove is made rectantular in cross-section.

11. The invention as in claim 9 wherein said longitudinal groove is made semicircular in cross-section.

12. The invention as in claim 9 wherein said beam is extruded from an aluminum alloy and wherein each of said return flanges is made with said upward-facing surface inclined downwardly toward said inward-facing edged, so as to assist in installing said beam onto the rail flange by tending to spread the upper edges of said sidewalls apart from each other and to guide said return flanges upwardly past the rail flanges to said installed position.

13. In a subceiling of the type having panels supported by a suspended framework of main runner members and cross runner members, each runner member being configured as an inverted T-bar rail having a transverse pair of opposed bottom flanges extending to a standardized total width, in combination with said rails and attachable thereto as decorative cover caps, a plurality of miniature hollow beams manufactured from plastic in an extrusion process including integral self-sufficient fastening means, each of said beams comprising:

a flat base portion;

a pair of generally vertical sidewalls flanking and adjoining said base portion, each of said sidewalls having an upper edge;

a longitudinal bridge web extending transversely between said sidewalls and attached thereto, in an upper region thereof, along said beam's full length, said web having been formed as part of a basic extrusion pattern; a first return flange, disposed along the upper edge of one of said sidewalls, extending inwardly; and a second return flange, disposed along the upper edge of the other of said sidewalls, extending inwardly;

each of said return flanges having an upward-facing surface, a downward-facing surface and an inward-facing edge;

wherein said sidewalls are spaced apart from each other, at least in an upper region, by a distance approximately equal to the total width of the rail flanges, and wherein said beam is made to be sufficiently compliant and resilient to enable attachment onto one of said rails by urging said beam upwardly against the rail flanges in a manner causing the return flanges to be temporarily spread apart compliantly from an original spacing so as to allow the return flanges to move upwardly past the rail flanges and to then return resiliently to the original spacing so as to thus captivate the rail flanges in an installed position such that the beam is (a) supported by the downward-facing surfaces of both return flanges resting upon upward-facing surfaces of the rail flanges, (b) constrained laterally by said sidewalls flanking said rail flanges, and (c) constrained downwardly by said web in relation to the rail flanges; thus said beam is caused to be securely attached to said rail, the panels being supported peripherally upon the upward-facing surfaces of said return flanges.

14. The invention as in claim 9, wherein each of said return flanges is made with said upward-facing surface inclined downwardly toward said inward-facing edge, so as to assist in installing said beam onto the rail flange by tending to spread the upper edges of said sidewalls apart from each and to guide said return flanges upwardly past the rail flange to said installed position.

15. The invention as in claim 13 wherein selected ones of said beams are each provided with a plurality of rectangular notches located in an upper region thereof, each of said notches being located at a potential location of a support framework intersection so as to provide clearance for the support framework intersection.

16. The invention as in claim 13 further comprising at least one pair of score lines of reduced strength located opposite each other in an upper region of said sidewalls, each of said score lines corresponding to at least a portion of a rectangular outline of a potential clearance notch location, so as to facilitate removal of material therefrom in forming a notch therein to provide clearance at a support framework intersection, whenever required.

17. The invention as in claim 13 wherein said sidewalls are shaped to have a longitudinal groove disposed in an upper region of each sidewall along the entire length thereof.

18. The invention as in claim 17 wherein each of said inward-extending return flanges is made with said upward-facing surface inclined downwardly toward said inward-facing edge, so as to assist in installing said beam onto the rail flange by tending to spread the upper edges of said sidewalls apart foerm each other and to guide said return flanges upwardly past the rail flanges to said installed postion;

wherein selected ones of said beams are each provided with a plurality of rectangular notches located in an upper region thereof, each of said notches being located at a potential location of a support framework intersection so as to provide clearance for the support framework intersection.

* * * * *